United States Patent [19]

Harris

[11] Patent Number: 4,706,748

[45] Date of Patent: Nov. 17, 1987

[54] PIPE SCRAPING DEVICE

[75] Inventor: Kim A. Harris, Casper, Wyo.

[73] Assignee: IMD Corporation, Denver, Colo.

[21] Appl. No.: 905,844

[22] Filed: Sep. 10, 1986

[51] Int. Cl.[4] ..... E21B 37/02

[52] U.S. Cl. ..... 166/173; 166/174

[58] Field of Search ..... 166/173, 174, 175, 176; 15/104.16, 104.17, 104.18, 104.05

[56] References Cited

U.S. PATENT DOCUMENTS

| | | | |
|---|---|---|---|
| 1,666,000 | 4/1928 | Campbell . | |
| 1,733,512 | 10/1929 | Parker . | |
| 1,772,710 | 8/1930 | Denney . | |
| 2,124,869 | 7/1938 | Rea | 166/10 |
| 2,130,267 | 9/1938 | Cowen | 166/174 |
| 2,157,493 | 5/1939 | Miller | 166/18 |
| 2,203,966 | 6/1940 | Otis | 166/174 |
| 2,216,674 | 10/1940 | Miller | 166/18 |
| 2,315,069 | 3/1943 | McKean | 166/18 |
| 2,679,293 | 5/1954 | Garrison | 166/18 |
| 2,728,398 | 12/1955 | Taylor | 166/170 |
| 2,826,077 | 3/1958 | Walker | 73/425.2 |
| 2,834,580 | 5/1958 | True | 255/76 |
| 2,857,141 | 10/1958 | Carpenter | 255/74 |
| 2,865,455 | 12/1958 | Rhoads | 166/170 |
| 2,882,019 | 4/1959 | Carr | 255/73 |
| 2,959,224 | 11/1960 | Ault | 166/43 |
| 3,034,581 | 5/1962 | Reynolds | 166/174 |
| 3,105,555 | 10/1963 | Villalon | 166/174 |
| 3,251,306 | 5/1966 | Plunk | 103/52 |
| 3,576,043 | 4/1971 | Zongker | 166/172 |
| 3,757,859 | 9/1973 | Hammon et al. | 166/173 |
| 4,034,807 | 7/1977 | Prince | 166/170 |
| 4,189,000 | 2/1980 | Best | 166/173 |
| 4,291,764 | 9/1981 | Pampell | 166/173 |
| 4,558,738 | 12/1985 | Howard, Sr. | 166/173 |

*Primary Examiner*—James A. Leppink
*Assistant Examiner*—Hoang C. Dang
*Attorney, Agent, or Firm*—Dorr, Carson, Sloan & Peterson

[57] ABSTRACT

A device for scraping the inside of pipes clogged with foreign materials is comprised of (1) a mandrel having a conical cam whose top is attached to a mechanical power source and around which is mounted (2) a plurality of annularly expandable scraper elements whose combined outside configuration approximates a tube which can be inserted into the pipe, and whose combined inside configuration approximates an expandable, conical dome into which the mandrel's conical cam is pulled in order to annularly expand the elements of the conical dome and hence expand the plurality of scraper elements as the entire device is pulled through the pipe and (3) means for limiting the annular expansion of the scraper elements.

5 Claims, 7 Drawing Figures

PIPE SCRAPING DEVICE

BACKGROUND OF THE INVENTION

1. Field of the Invention

This invention is generally concerned with devices for scraping the insides of pipes in general and oil and/or gas well casings in particular.

2. Description of the Prior Art

Pipes of all kind are subject to becoming clogged with the materials they convey. For example, in the drilling, completion or workover of an oil well, the interior of the well casing or other conduit is exposed to a variety of foreign materials which often tend to adhere to the internal surface of the conduit. Drilling mud, paraffin, cements, rust and/or scale build up in ever increasing layers until finally the flow of fluids through the pipe is effectively choked off. Therefore, to permit the unimpeded passage of pumping equipment, perforating equipment and the like into and out of well casings, it is obviously desirable that all foreign substances adhering to the interior walls of the casing first be removed. Additionally, burrs resulting from perforation operations sometimes prohibit the free passage of packing and other elements through the well, and such burrs of necessity must therefore be removed.

To effect such removal, a number of scraping tools have heretofore been employed. Most commonly used prior art scrapers have been characterized by the fact that they employ rotating pipes to effect scraping operations. Most of these in turn are also characterized by the fact that they have only a limited effective diametrical range of operation. For example, it is known that a seven inch interior diameter well casing may have five or more different internal diameters, dependent on the casing weight required for the particular installation. The thickness and hardness of the materials deposited on the interior of the pipe are also subject to a great deal of variation over relatively short distances within the pipe. As a result, the scraping apparatus hereto available required the installation of various sizes of blade blocks, one at a time, on the tool support in order to scrape the full range of internal diameters provided in seven inch casing. Moreover, a great deal of time and effort is needed to assemble a string of pipes to carry out any scraping operation based upon a powered rotation of the pipes to which such scrapers are attached.

It has been long recognized that scraping devices capable of being operated from a cable lowered into such a pipe would save a great deal of time. However, most prior art cable operated scrapers have not proven to be particularly effective. Many operators regard cable operated scrapers as being especially ineffective in scraping in an "upward" direction, that is, from the bottom of the well toward the top. Moreover, such devices also have not proved to be particularly useful for scraping heavily caked walls. Furthermore, they also heretofore have not been able to scrape the entire 360 degrees of the inner circumference of such pipes. Cable operated devices They also have been more prone to becoming lodged in clogged pipes than are their rotary operated counterparts. Furthermore, most prior art cable operated pipe scraping devices are not susceptible to automatic adjustments of the effective working diameter of the scraping elements during operations. Hence, these devices have to be practically disassembled in order to achieve any scraping diameter adjustments. In many instance, this implies more passes of the scraper through a clogged pipe. It should also be noted that most cable operated scrapers are not particularly suited to ready conversion for use in rotary powered scraping operations.

Moreover, most automatic, diameter adjusting scraper devices are based upon a spring biased scraping mechanisms which do not readily withstand the loads and rough handling inherent in scraping operations. Such springs are frequently the first part of the device to fail. Moreover, many prior art scraping devices do not incorporate a simple means for compensating for wear on their scraper blades; thus they require replacement of the entire blade assembly whenever any significant wear takes place. Additionally, the mounting of blade blocks on most prior art apparatus is such that if a jam occurred between the scraper surface and an obstruction in the casing, it was generally quite difficult to pull the tool free since the spring loaded cutting surfaces are usually permanently biased in the outward direction once the scraper is inserted into the pipe. It is therefore apparent that there is a distinct need for an improved, more flexible, readily adjustable scraping apparatus for pipes of all kinds and oil and gas well casings in particular. This need is particularly apparent in the case of pipe scrapers operated by pulling upon cables attached to devices of this type.

SUMMARY OF THE INVENTION

This invention provides a pipe scraping device of particularly rugged construction. It is capable of automatic annular expansion within certain defined limits depending on the amount and hardness of the foreign materials encountered. It is also particularly suited to cleaning operations in the upward direction, that is from the bottom of a clogged pipe (a oil or gas pipe in place) to its top. This device is capable of being operated both by a powered cable, capable of pulling the device through the clogged pipe, and, if need be, by a string of pipes driven by a rotary power source. This is a definite advantage, in that cable powered scraping operatios are highly preferred, if they can adequately perform the scraping operation, since they require far less assembly, labor and operating time than scraping operations based upon power driven rotatable work strings of pipe or casing. However, some scraping operations do require rotary operations. Sometimes it is necessary to drill a hole downward through the caked foreign material before any other upward scraping operations can be carried out.

The scraping devices of this invention generally comprise a mandrel base, preferably of a cylindrical configuration, upon which a generally conical shaped mandrel is mounted and around which a series of scraper elements are mounted to form a tube-like outer wall which serves as the scraping surface. The inner wall of the scraping elements forms an annularly expandable conical dome into which the cam is pulled by the pulling action of the cable or of a pipe string. Preferably, the mandrel base and the cam are a solid, single piece, machined to the proper configuration. The bottom of the mandrel base can be provided with attachment means, such as a threaded hole, for attaching those additional tools and weights commonly employed in pipe cleaning operations, especially those carried out in oil and gas well operations. This hole can also serve as the means, hereinafter more fully described, by which this device is operated in an "upside down" mode to drill a hole through strongly caked foreign materials. In any event, the front, or bottom, of the generally cylindrical shaped mandrel base can be beveled or otherwise pointed to facilitate "right side up" movement through a pipe filled with fluids and particulate matter. Again, the mandrel can be affixed to the base, but a mandrel comprised of a mandrel base and a cam made as a single piece, machined into the appropriate configuration, will provide a scraper device of particularly rugged, durable construction.

In the most preferred embodiments of this device, the cam will be in the form of a solid cone. The base of the conical cam could completely coincide with, or even overlap, the top of the mandrel base. However, in a highly preferred embodiment of this invention, the diameter of the base of the cone-shaped cam will be less than the diameter of the mandrel base. This difference in diameters will produce a seat around the top of the mandrel base. This seat can serve as a seat upon which the bottom of a conical wall, formed by scraper elements, hereinafter more fully described, abut in order to limit the downward movement of the scraper elements with respect to the mandrel. This seat can also be built up with rings or shims to raise the surface upon which the bottoms of the scraper elements will abut.

The upward movement of the scraper elements is most conveniently limited by the bottom surface of a cross-over piece attached to the top of the conical-shaped cam. In a highly preferred embodiment of this invention, the top of the conical-shaped cam ends in a threaded bolt-like top which threads into a threaded hole in the bottom of a cross-over piece. The cross-over piece serves as a means of interconnecting the device of this invention to a source of mechanical power. Preferably, that power source will be a cable attached to the top of the cross-over piece by means of a threaded attachment. Such a cable can also be attached by means of an eye for receiving the cable, or a U-bolt which is, in turn, attached to the cable. Again, the source of mechanical power also can be a powered rotating string of pipes attached to a threaded top on the cross-over piece or attached directly to the threaded bolt-like top of the conical shaped cam.

The device further comprises a plurality of scraper elements which, when associated in a first position, form an annular, tube-like outer wall capable of being inserted into this pipe and which, when annularly expanded to a second position, form a split, tube-like outer wall which engages with and scrapes foreign material from the inside of the pipe. The plurality of scraper elements can be two or more such elements. However, an assembly having three elements whose outside walls each span about 120 degrees when the elements are assembled in their nonexpandable tube-like cylinder or first position is highly preferred configuration. Obviously, these outside walls will represent less than about 120 degrees when the tube-like cylinder is split apart—that is when the device is in its second or expanded configuration. That is to say the splits or gaps between the elements of the tube will account for some portion, which preferably are less than about 60 degrees, of the 360 degrees of the circumference of the split outer wall. However, in certain preferred embodiments of this device, these splits are cleaned by teeth which form a part of the outer wall of this device. In other words, the teeth will serve to clean in the gap regions between the scraper elements.

In another highly preferred embodiment of this invention, the radially outward or annularly expanded movements of the scraper elements can be limited by the same means which hold the scraper elements in their expandable, annular assembly of the mandrel. In one highly preferred embodiment of this invention, the means for holding the scraper elements in such annular assembly is a series of bolts which connect adjacent ribs in a loose association. The ribs themselves serve to hold the tube-like outer wall in a concentric relationship with the cone-shaped inner wall which engages the cone-shaped cam as it is pulled higher into the cone-shaped inner wall by the pulling force delivered by the source of mechanical power.

Preferably, the bolts which limit the annular expansion of the scraper elements function as follows: The front end of the shaft of each bolt is preferably tightly threaded, or even welded, into a hole in the rib of a scraper element. The remainder of the shaft of the bolt is allowed to fit loosely in an aligned, but slightly larger hole in the adjacent rib. Thus in the case where the scraper elements are supported by ribs at the end of the arc or sector defined by the scraper element, the adjacent ribs will abut against each other when the scraper elements are assembled in their contracted or first position. This first position presents the smallest outer wall diameter possible. Obviously, this diameter must be such that it allows the device in general, and the outer wall of the assembly in particular, to be inserted into the bore of the pipe to be scraped. With this arrangement, the scraper elements will annularly expand until the head of the bolt encounters the rib and/or the bottom of the conical inner wall encounters the seat on the mandrel base. Threadable bolts can be adjusted so that the expansion of the ribs away from each other is limited by abutment of the bolt head against the expanding rib. Thus, the bolts can be adjusted so the bolt head/rib abutment takes place just as the bottom of the inner wall abuts against the seat on top of the mandrel base.

However, by tightening the bolts into the rib containing the threaded hole which receives the bolt, the annular expansion of the outer wall can be limited so that the bolt head abutment takes place before there is any contact between the bottom of the inner wall and the seat on the mandrel base. Those skilled in this art will of course appreciate that the seat on the mandrel base can also be built up with rings or other shim devices so that the bottom of the inner wall is, in effect, again abutted against a seat (rings or shim) when the bolts are tightened such that the bolt heads abut against the ribs in an annular expansion less than the annular expansion permitted by inner wall contact with the top of the mandrel base itself. In any case, adjustment of the annular expansion of the outer wall can be accomplished by threading each bolt into or out of a threaded hole in each adjacent rib.

Such an adjustment is a useful feature since the scraper elements will tend to expand to their second or fully expanded position whenever the foreign material is caked strongly enough to produce a strong resistance to the pulling force upon the cable. This condition, in turn, will pull the cam higher into the conical inside wall of the scraper elements and thus expand the outer wall. In many other instances, however, the foreign material will not offer sufficient resistance to the device to expand it to its fully expanded or second position. This circumstance makes this device capable of automatically annularly expanding to deal with varying degrees of resistance produced by foreign materials. In other words the second, or expanded, position may vary and not necessarily be a position defined or limited by either inner wall/seat contact or by the bolts which hold the scraper elements in their annular assembly. In all cases, however, the ability to limit the annular expansion of the outer wall before the seat and the bottom of the inner wall abut is a very useful feature of this device. For one thing, it enables the operator to make a first pass through a particularly strongly caked pipe at a first, smaller, outside wall diameter so that the first pass encounters less resistance to being pulled. The outside wall diameter can then be systematically enlarged by loosening the assembly bolts for each subsequent pass through the clogged pipe.

To facilitate such adjustments, the outside wall may be further provided with holes through which tools such as sockets can be passed to facilitate adjustment of these bolts. In another preferred embodiment of this invention the outside wall can be also provided with a tooth and tooth receiver system to assure that the pipe is scraped around the entire 360 degrees of its inside surface. In other words, the tooth in general, and the top of the tooth in particular will serve as a scraper element in the regions where the slot or gap between the outer wall elements is formed when the device is in its expanded configuration. There could be any number of teeth per slot, but most preferably, there will be at least one tooth per slot. In this arrangemet, the full 360 degree circumference of the pipe will be scraped. Each tooth will preferably be of the same circular configuration as the outer wall. Thus, this tooth system will form a continuous part of the outside wall surface when the scraper elements are in their assembled or first position.

The scraper elements of the outer wall can be connected to its inner wall by one or more ribs. Obviously if each scraper element were provided with only one such rib, then that rib would best be located somewhere near the center, i.e., at 60 degrees of the 120 degree arc defined by the outer wall. In a highly preferred embodiment of this invention, however, each outer wall segment will be affixed to its respective inner wall segment by means of two ribs, one near one end (i.e., at about zero degrees) of the 120 degree arc of the outer surface and the other near the other end (i.e., at about 120 degrees) of the arc of the outer surface. The use of more ribs e.g., 3, 4, etc., is less preferred since they tend to clog up the cavity defined between the outer and inner wall. This cavity is preferably left open since it permits the foreign material scraped from the wall to fall through the device to the bottom of the pipe, rather than build up in front of the device as the scraping operations continue.

This device has yet another useful feature. It can be used in an inverted or "upside down" orientation. For example, in the case of a vertical pipe cleaning operation, the device could be suspended from the mandrel base rather than from the top of the conical cam. The attachment means on the bottom of the base can be used to mount a cross-over piece which will connect this device to a rotary power source. However, in this inverted orientation, the scraper elements will only expand if the device is forced downward through the clogged pipe in the manner of a drill bit. Cable operations will not be particularly effective since a pull upon the bottom of the nosepiece will force the scraper elements to their contracted configuration rather than to their expanded configuration. Hence if this device is used in its inverted orientation, then it will best be used in conjunction with a rotary powered string of pipe to bore downward (at least in the case of a vertically set pipe) through the foreign material. To this end specially adapted pieces can be attached to the bolt or other attachment means located on the "top" (it becomes the bottom in the case of inverted use) of the conical cam otherwise used to attach the cross-over piece to the source of mechanical power. For example, a piece having a screw or drill bit-like configuration may be attached to the conical cam. It can serve to bore through the center if the clogged pipe and/or direct loosened foreign materials into the cavity between the outer and inner walls. Those skilled in the art will also appreciate that when this device is operated in its inverted orientation, the scraper elements can be held in their second, or expanded configuration by means of a spring or collar inserted between the nosepiece attached to the conical cam and the top of the inner wall and/or the ribs.

DESCRIPTION OF PREFERRED EMBODIMENTS

Figure 1:
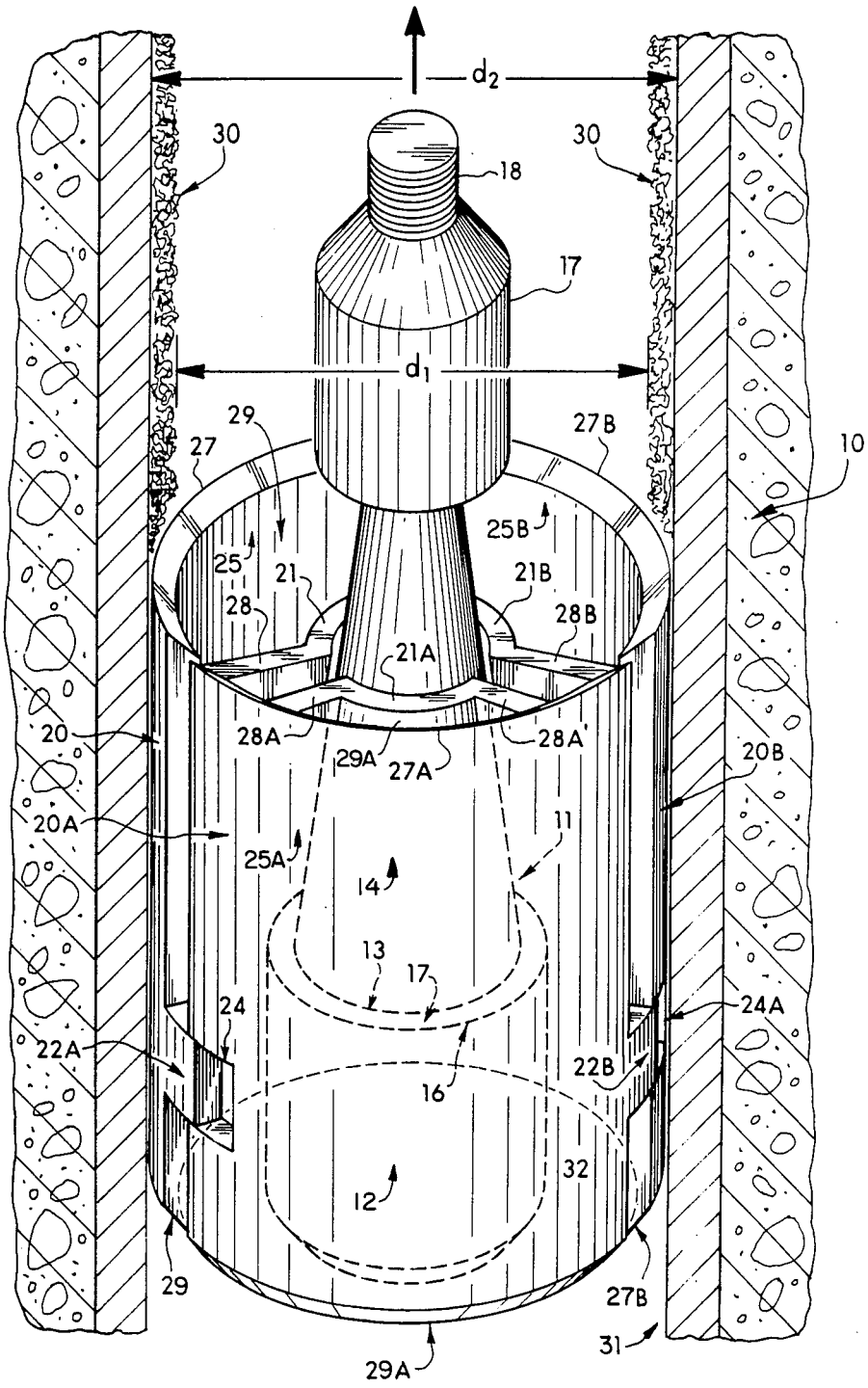
FIG. 1 is a perspective view of a pipe scraping device embodying this invention.

FIG. 1 is a perspective view of the pipe scraping device 10 in its annularly expanded, or second, position. The mandrel 11 is comprised of a mandrel base 12 upon which a cam 14 having a conical configuration is mounted. In a preferred embodiment of this scraper device the circumference of the base 13 of the conical cam 14 is less then the circumference of the top 16 of the mandrel base 12 such that a seat 15 is formed between the top 16 of the mandrel base 12 and the base 13 of the cam 14. A cross-over piece 17 is attached to the top of the conical cam 14. The top 18 of the cross-over piece 17 is provided with means such as threads for connecting the device to a source of mechanical power. In this particular figure, the pipe scraping device 10 is shown provided with three scraper elements 20, 20A and 20B. In a preferred embodiment of this scraping device, each scraper element 20, 20A and 20B is further provided with at least one tooth e.g., 22A and 22B. Each such tooth fits into an appropriate slot or receiver e.g. 24, 24A of the adjacent scraper element when the device is in its first; or contracted position. When the device is in its expanded configuration, the teeth serve to assure that the device presents a full 360 degree scraping surface.

As will be made more apparent in FIG. 2, each scraper element is comprised of an outer wall e.g. 25, 25A and 25B and an inner wall e.g., 21, 21A and 21B, connected by ribs e.g., 28, 28A and 28B. In a preferred embodiment of this invention each scraper element is provided with two ribs e.g. 28A and 28B, one on each side of the scraper element, so as to define an open cavity 29 so that foreign materials 30, scraped from the inside of pipe 31, may fall through the device 10. Hence, scraped material will not build up ahead of the device as it is drawn up through the pipe. As will be better illustrated in FIGS. 2 and 3, the bottom of the inner walls 21 21A and 21B may abut against the seat 15 defined between the outside circumference of the mandrel base 16 and the base 13 of the cam 14 when the scraper elements are in their most fully expanded, scraping position. The preferred scraping surfaces are the tops i.e., 27, 27A and 27B of the scraper elements. These tops are preferably sloped or beveled from a lower position on the inside of the inner wall to the outside circumference of the outer wall 20. The tops of the teeth may be similarly sloped. The cutting surface may be straight and/or serrated. Additional scraping or guide elements could also be located on the outside circumference of the scraper elements away from their tops. However, the use of such additional scraper elements or guides, located in the lower regions of the outer wall, is a less preferred embodiment of this invention. The lower edges 29, 29A and 29B of the scraper elements may be beveled inwardly as shown for better downward movement of the device.

Figure 2:
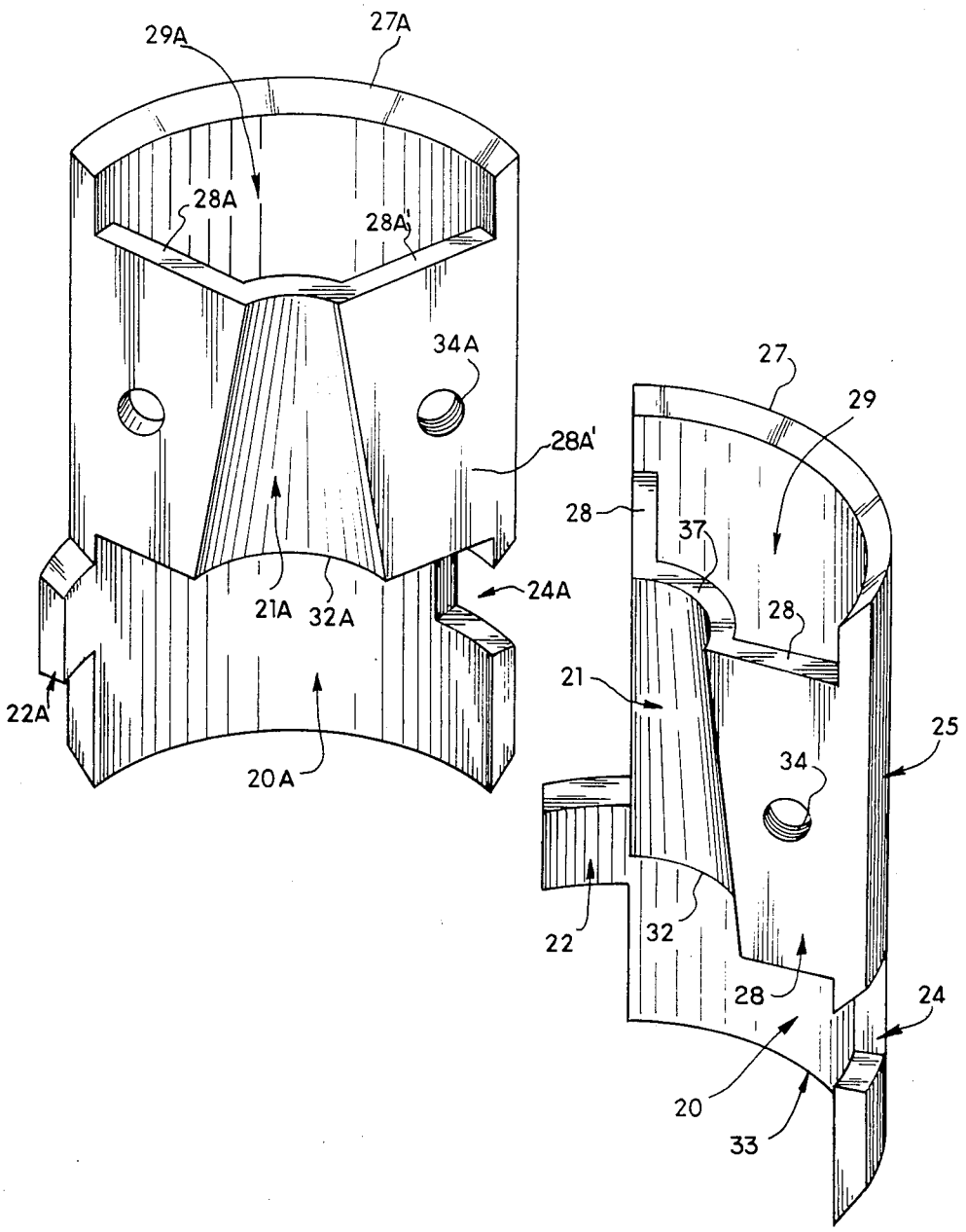
FIG. 2 is a perspective view of two scraper elements of this device.

FIG. 2 is a perspective view of two typical scraper elements 20 and 20A. It illustrates that the cross section of each scraper element takes the form of an annularly truncated sector having a cavity 29 through which the foreign material falls after being scraped from the inside of the pipe, not shown. The top surface 27 of the outer wall 25, as well as the top surface of both ribs 28 and 28A are shown as cutting edges slopping downward from the outside surface of the cavity. Scraped foreign passes through this cavity 29. The principles of operation of this device are such that the device will operate with a plurality of scraper elements; however, devices having 3 or 4 scraper elements are highly preferred. Regardless of the number of scraper elements, however, the outer wall will define a tube-like configuration and the inner wall will define a conical surface encountered by the mandrel cam as it is pulled through the pipe being cleaned. FIG. 2 also illustrates that the bottom surface 32 of the inner wall 21 does not extend as deep as the bottom 33 of the outer wall 25. It is this bottom surface 32 of inner wall 21 which abuts against the seat 15 of the mandrel 11 as it is pulled through the pipe. Hence, the upward movement of the mandrel 11 in the conical surface defined by the inner walls of the combined scraper elements can be set so that the outside diameter $d_1$ (as shown in FIG. 1) of the scraper elements in their fully expanded position is fixed to be slightly less than the inside diameter $d_2$ (as shown in FIG. 1) of the pipe being scraped. Moreover, this limitation may be augmented or further defined by the means 34 hereinafter more fully described by which the scraper elements are held in their expandable annular configuration. In any case, those skilled in this art will appreciate that in the most preferred embodiments of this invention the outside diameter $d_1$ will be predetermined by the size of the pipe of being cleaned. For example, common sizes for oil well pipe range from about $2\frac{3}{4}$ up to about 36 inches with $4\frac{1}{2}$ and $5\frac{1}{2}$ in pipes being the most widely used sizes. There are many different weights; therefore, obviously this device will most preferably be designed to fit a narrow range of common sizes, e.g., $4\frac{1}{2}$ to $5\frac{1}{2}$ inch pipes, or even a particular pipe size, e.g., $5\frac{1}{2}$ inches, rather than try to scrape pipes of widely varying diameters.

Figure 3:
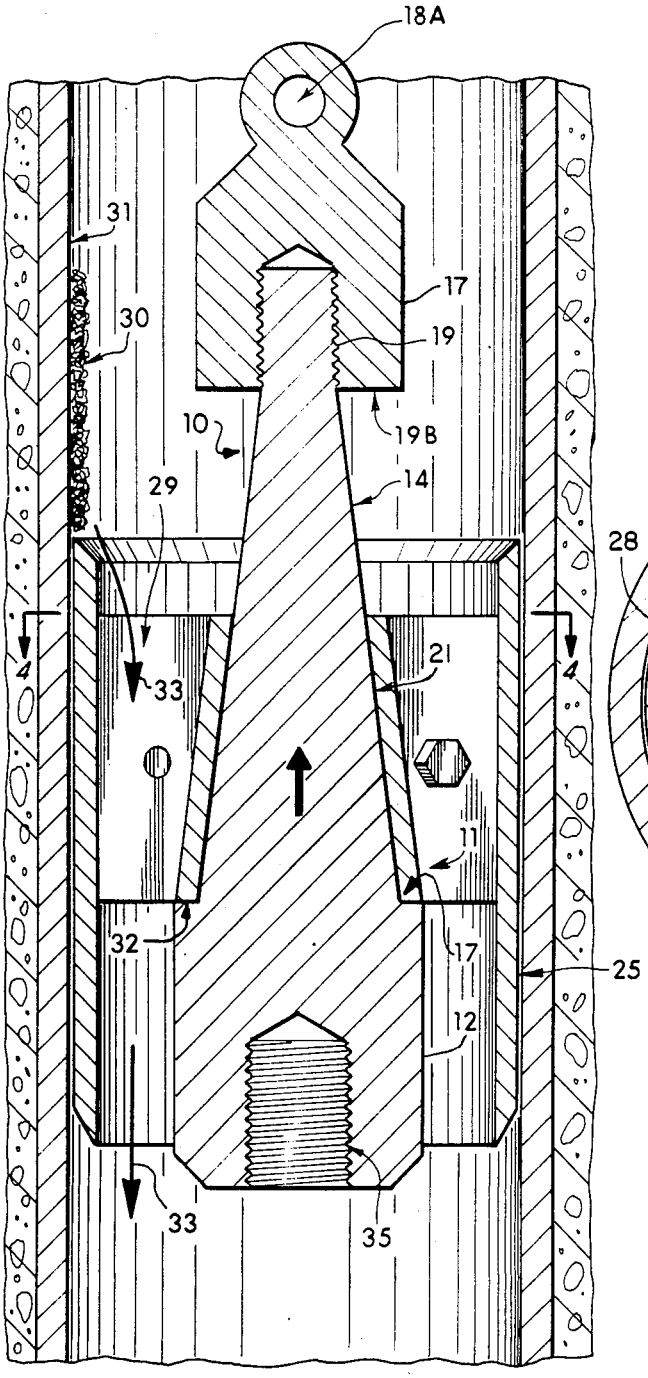
FIG. 3 is a side, cross-sectional view showing a preferred embodiment of the device in its annularly expanded position.

FIG. 3 shows a side view of the scrape device 10 in its second, or fully expanded, position. In this position, the seat 15 of mandrel base 12 is in abutting contact wtih the bottom 32 of the inner wall 21. Again, rings or shims (not shown) could be used to build up the seat 15 when desired. The expanded position is such that foreign material 30 will be scraped from the inside 31 of the pipe and fall through the cavity 29 in the general direction indicated by arrows 33. The top region of the mandrel's conical shaped cam 14 is shown with a means such as threads 19 for attaching the mandrel 11 to a cross-over piece 17 for connecting the device 10 to a source of mechanical power, not shown. In one highly preferred embodiment of this device, the device is pulled by a cable which can be, either directly or in conjunction with a U-bolt, passed through an eye 18A in the cross-over 17. The mandrel base 12 may also be provided with means such as a threaded hole 35 for attaching other tools, or weights to the device. The weights (not shown) are useful for "sinking" the device into a pipe filled with fluids.

Figure 4:
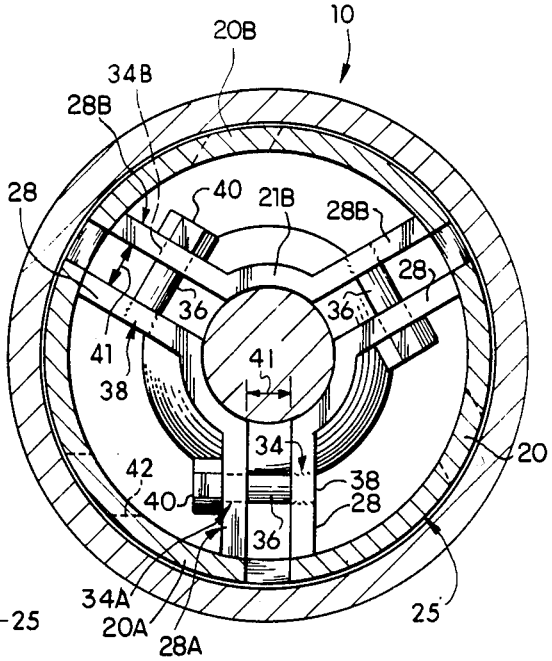
FIG. 4 is a top cross-sectional view of this device in its annularly expanded position.

FIG. 4 illustrates a top cross sectional view of the device 10 in its expanded configuration. It particularly illustrates a preferred means for maintaining the scraper pieces in an expandable annular configuration. Here the ribs 28, 28A and 28B are provided with adjacent, coinciding, holes through which bolts 36 pass. The nose of bolt 38 can be threaded into a hole 34 in one rib e.g., 28 while the bolt is left loose in the adjacent hole 34A. Thus the head 40 of bolt 36 will limit the annular expansion of the scraper elements. That is, the gap 41 between the ribs 28 and 28A of the scraper 20 and 20A will be limited when rib 28B expands away from rib 28 enough to abut against the bolt head 40. This distance may be set to coincide with the limit defined by the abutment of the seat 15 with the bottom 32 of inner wall 21. In the alternative the nose of the bolt may simply be welded into the first hole or otherwise affixed to the rib. This, however, will limit the annular adjustability of this device.

Figure 5:
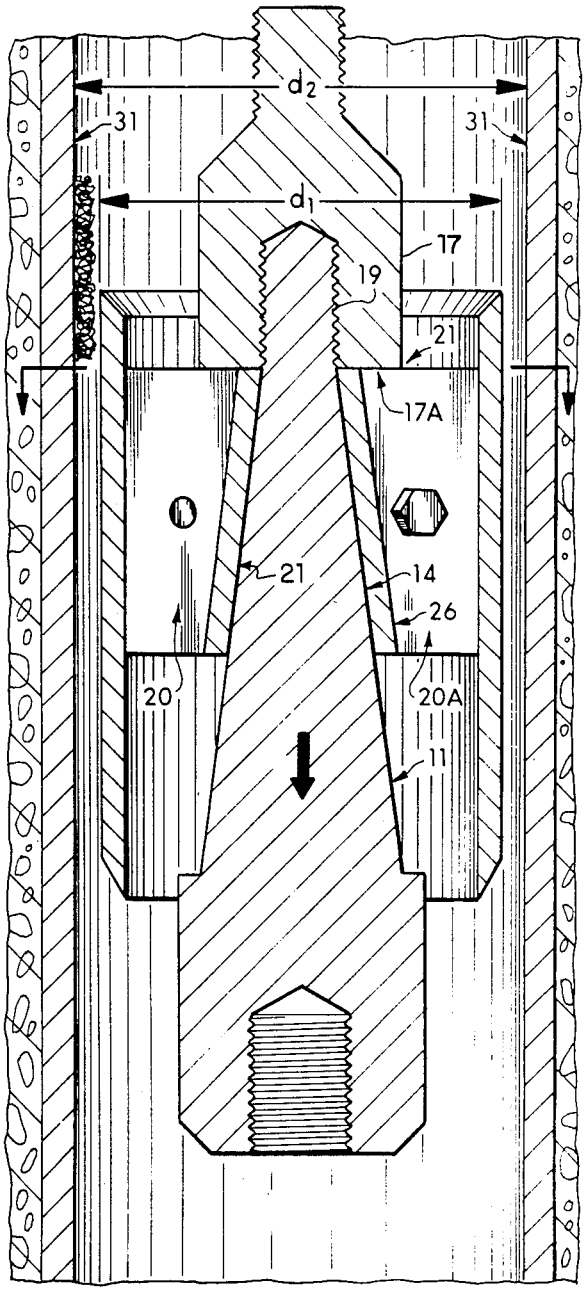
FIG. 5 is a side, cross-sectional view showing a preferred embodiment of this device in its annularly contracted position.

FIG. 5 shows a side cross-sectional view of the scraper device 10 in its first, or fully contracted position. In this position, the scraper elements are in their fully contracted, tube-like configuration. The diameter $d_1$ of the assembled outer wall elements 20, 20A etc. is at its minimum. This diameter $d_1$ is of course less than the inner diameter $d_2$ of the pipe 31 to be cleaned. In most instances it will also be less than the effective diameter of the bore defined by the foreign material caked on the inside of the pipe. The upward movement of the scraper elements 20, 20A, etc. with respect to the mandrel is preferably limited by a cross-over piece 17 attached to the top of the conical-shaped cam. That is to say the upward movement stops when the top 37 of the conical, inner wall element 21 abuts against the bottom 17A of the cross-over piece 17. In this raised position, the cam 14 is not in operating contact with the conical inner wall.

Figure 6:
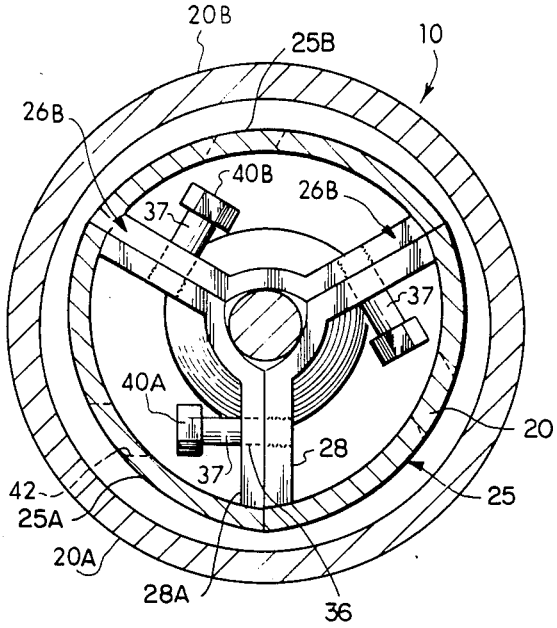
FIG. 6 is a top, cross sectional view of this device in its annularly contracted position.

FIG. 6 is a top, cross-sectional view of the device 10 in its contracted or first position. In this position, the ribs e.g., 28 and 28A, 28A and 28B etc. abut against each other. The bolts 36 are not functioning as limits to annular expansion of the scraper elements. For example, the rear portions 37 of bolts 36 between the rib 28B and the head 40B are shown exposed to indicate that the bolts are free to move e.g., in hole 34B of rib 28B, and thereby allow for the expendability of the scraper elements anywhere from the smallest outside diameter of the outer wall 25, 25A and 25B shown in this FIG. 6 to the largest possible diameter depicted in FIG. 4.

Figure 7:
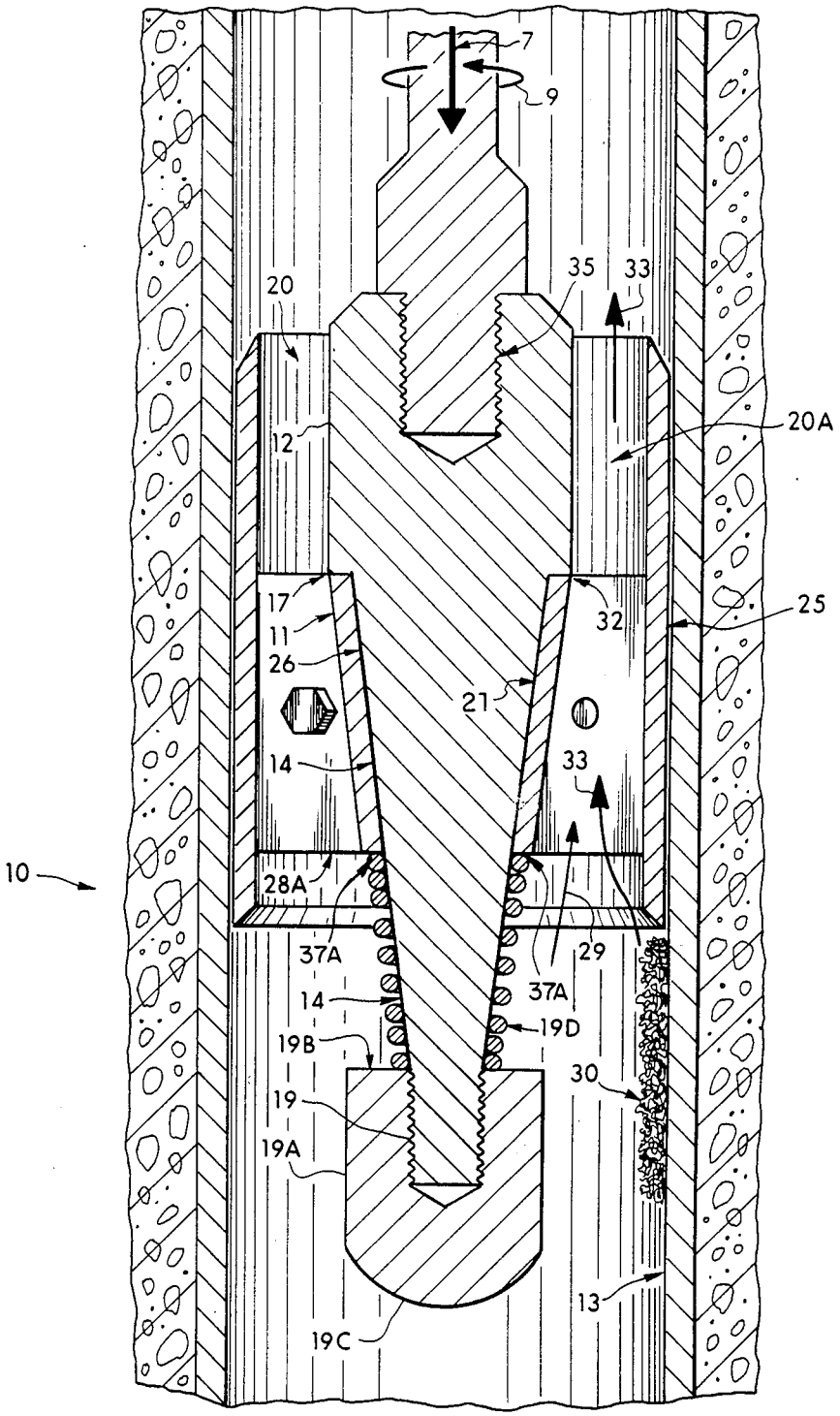
FIG. 7 is a side, cross-sectional view showing the device being used in an inverted orientation.

FIG. 7 illustrates the device of this invention in its inverted orientation. It will most preferably be forced down the pipe as indicated by the direction of arrow 7. This may be accomplished by a string of pipes, not shown. Moreover, the pipes may be under the action of a rotary power source, not shown, but generally indicated by arrow 9. In this inverted mode of operation, the bottom (the top in the right-side up mode previously discussed) of the conical cam 14 optionally, can be fitted with a nosepiece 19A having a boring means such as a screw, auger, or drill bit, attached to its bottom or downward leading end. This boring means can aid in boring through heavily clogged pipes. In this inverted mode of use, the scraper elements 20, 20A, 20B would tend to fall, under the influence of gravity, to the bottom of the conical cam, and hence to their contracted configuration. This tendency can be obviated by placing a spacer means 19D between the top 19B of the nosepiece 19A and, for example, the bottom 37A of the inner wall 21 and/or the top of the ribs 28A. This spacer means could be a spring such as the one shown in FIG. 7, or a conical collar which surrounds the conical dome of the cam 14.

Those skilled in this art will appreciate that many variations in this device can be made without departing from the scope and spirit of this patent disclosure. For example, the device can be used to clean and scrape pipes of any size. Similarly, the pipe can be used to scrape foreign materials from pipes used to convey fluids other than oil and gas, such as for example, pipes used to carry sewage, paper pulp, chemicals, coal slurries, etc. Finally, the device can be used to scrape pipes lying horizontally, above or below ground level, as well as those in a vertical orientation, above or below ground level.

Thus having disclosed my invention, I claim:

1. A pipe scraping device comprising:

a mandrel having a mandrel base to which a cam is mounted, said cam having a generally conical configuration which tapers from a base, mounted upon the mandrel base, to a top which includes a means for connecting the mandrel to a source of power capable of pulling the device through a pipe;

a plurality of scraper elements which, when associated in a first position, form an annular, tube-like outer wall capable of being inserted into the pipe, and which, when annularly expanded to a second position, form a split, tube-like outer wall which scrapes foreign material from the inside of the pipe, and wherein each scraper element comprises:

an outer wall segment which, when the plurality of scraper elements are in the first position, forms a segment of the tube-like outer wall and which, when the plurality of scraper elements are in the second position serve to scrape foreign material from the inside of the pipe;

at least one rib element which holds the outer wall segment in a fixed concentric relationship to an inner wall segment and thereby define a cavity between the outer wall segment and the inner wall segment through which scraped foreign material may pass;

an inner wall segment which, when the plurality of scraper elements are in the first position forms a segment of a conical camming surface against which the cam is urged by pulling said cam higher into the conical camming surface and thereby splitting and annularly expanding the conical camming surface which in turn expands the outer wall segment to its second, foreign material scraping, position;

means for holding the scraper elements in an expandable, annular configuration; and means for limiting movement of the mandrel higher into the conical camming surface.

2. An oil well casing scraper device comprising:

a mandrel having a cylindrical mandrel base to which a cam is mounted, said cam having a cylindrical nose piece and a generally conical configuration which tapers from a base whose diameter is less than the diameter of the cylindrical mandrel base upon which the cam is mounted and thereby forming a seat between the base of the cam and the circumference of the cylindrical mandrel base, to a top which includes a round threaded portion for connecting the mandrel to a cross-over piece which in turn is connected to a source of power capable of pulling the device through a pipe;

three scraper elements which, when associated in a first position, form an annular, tube-like outer wall capable of being inserted into the pipe, and which, when annularly expanded to a second position, form a split, tube-like outer wall which scrapes foreign material from the inside of the pipe, and wherein each scraper element comprises:

an outer wall segment which, when the three scraper elements are in the first position, forms about a 120° arc segment of the tube-like outer wall and which, when the three scraper elements are in the second position serves to scrape foreign material from the inside of the pipe, each located inside the 120° arc segment and two rib elements which hold the outer wall segment in a fixed concentric relationship to an inner wall segment and thereby define a cavity having a truncated sector configuration between the outer wall segment and the inner wall segment through which scraped foreign material will pass;

an inner wall segment which, when the three scraper elements are in the first position forms about a 120° segment of a conical camming surface against which the cam is urged by pulling said cam higher into the conical camming surface and thereby splitting and annularly expanding the conical camming surface which in turn expands the outer wall segment to its second, foreign material scraping position, said inner wall segment having a vertical height less than the vertical height of the outer wall segment such that the bottom of the inner wall segment forms a seat against which the seat of the mandrel finally abuts as it is pulled up through the conical camming surface, a plurality of bolts each of which pass through aligned holes in adjacent rib elements and thereby hold the scraper elements in an expandable, annular configuration; and bolt means connecting adjacent ribs for holding the scraper elements in an expandable, annular configuration; and an abutment defined by the bottom of the inner wall for limiting movement of the seat of the mandrel higher into the conical camming surface.

3. An oil well casing scraper device comprising:

a mandrel having a cylindrical mandrel base portion and a mandrel cam portion, said cam portion having a generally conical configuration which tapers from a base whose diameter is less than the diameter of the cylindrical mandrel base to which the mandrel cam portion is affixed and thereby forming a seat between the base of the mandrel cam portion and the circumference of the cylindrical mandrel base, to a top which includes a round threaded portion for connecting the mandrel to a cross-over piece which in turn is connected to a powered cable capable of pulling the device through the well casing;

three scraper elements which, when associated in a first position, form an annular, tube-like outer wall capable of being inserted into the pipe, and which, when annularly expanded to a second position, form a split, tube-like outer wall which scrapes foreign material from the inside of the pipe, and wherein each scraper element comprises:

an outer wall segment which, when the three scraper elements are in the first position, forms about a 120° arc segment of the tube-like outer wall and which, when the three scraper elements are in the second position serve to scrape foreign material from the inside of the pipe, two rib elements each located inside of the pipe, two rib elements each located inside the 120° arc segment which serves to hold the outer wall segment in a fixed concentric relationship to an inner wall segment and thereby define a cavity having a truncated sector configuration between the outer sector wall segment and the inner wall segment and through which scraped foreign material may pass, and wherein the outer wall segment further comprises a tooth and tooth receiver for scraping open regions between the three scraper elements when the device is in its second, expanded position;

an inner wall segment which, when the three scraper elements are in the first position forms about a 120° segment of a conical camming surface against which the mandrel cam portion is urged by pulling said mandrel cam portion higher into the conical camming surface and thereby splitting and annularly expanding the conical camming surface which in turn expands the outer wall segment to its second, foreign material scraping position, said inner wall segment having a vertical height less than the vertical height of the outer wall segment such that the bottom of the inner wall segment forms a bottom against which the seat of the mandrel finally abuts as it is pulled up through the conical camming surface, a plurality of bolts each of which pass through aligned holes in adjacent rib elements and thereby hold the scraper elements in an expandable, annular configuration and define the limit of annular expansion of the outer wall; and an abutment defined by the bottom of the inner wall for limiting movement of the seat of the mandrel higher into the conical camming surface and thereby at least partially defining the limit of annular expansion of the outer wall.

4. An oil well casing scraper device comprising:

a mandrel having a cylindrical mandrel base portion which includes means for attaching the mandrel base portion to a source of mechanical power and a cam portion, said cam portion having a generally conical configuration which tapers from a base whose diameter is less than the diameter of the cylindrically mandrel base to which the cam is affixed and thereby forming a seat between the base of the cam portion and the circumference of the cylindrical mandrel base, to a bottom which includes a round threaded portion for connecting the mandrel to a nosepiece;

three scraper elements which, when associated in a first position, form an annular, tube-like outer wall capable of being inserted into the pipe, and which, when annularly expanded to a second position, form a split, tube-like outer wall which scrapes foreign material from the inside of the pipe, and wherein each scraper element comprises:

an outer wall segment which, when the three scraper elements are in the first position, forms about a 120° arc segment of the tube-like outer wall and which, when the three scraper elements are in the second position serve to scrape foreign material from the inside of the pipe, two rib elements each located inside the 120° arc segment which serve to hold the outer wall segment in a fixed concentric relationship to an inner wall segment and thereby define a cavity having a truncated sector configuration between the outer wall segment and the inner wall segment and through which scraped foreign material may pass, and wherein the outer wall segment further comprises a tooth and tooth receiver for scraping the open regions between the three scraper elements when the device is in its second, expanded position;

an inner wall segment which, when the three scraper elements are in the first position forms about a 120° segment of a conical camming surface against which the cam portion is urged by forcing the scraper elements upward, toward the mandrel base and thereby splitting and annularly expanding the the inner wall segment which in turn expands the outer wall segment to its second, foreign material scraping position, said inner wall segment having a vertical height less than the vertical height of the outer wall segment such that the top of the inner wall segment forms a bottom against which the seat of the mandrel finally abuts as the scraper elements are forced higher upon the the cam portion, a plurality of bolts each of which pass through aligned holes in adjacent rib elements and thereby hold the scraper elements in an expandable, annular configuration and define the limit of annular expansion of the outer wall segment;

an abutment defined by the top of the inner wall segment for limiting movement of the upward movement of the scraper element with respect to the the cam portion and thereby at least partially defining the limit of annular expansion of the outer wall segment; and spacer means, located between the nosepiece and the bottom of the inner wall segment of the scraper element, for holding the scraper element in its expanded position.

5. The scraper device of claim 4, employed in an inverted orientation, which further comprises a boring means on the lower end of the cam portion and a spacer means placed between the boring means and the inner wall segment.

* * * * *